United States Patent [19]

Van Heel

[11] Patent Number: 4,769,000

[45] Date of Patent: Sep. 6, 1988

[54] CENTRIFUGE, IN PARTICULAR FOR BIOMEDICAL USE

[75] Inventor: Hubertus-Johannes G. Van Heel, Fleringen, Netherlands

[73] Assignee: Ultra-Centrifuge Nederland N.V., Almelo, Netherlands

[21] Appl. No.: 930,928

[22] Filed: Nov. 17, 1986

[30] Foreign Application Priority Data

Nov. 15, 1985 [NL] Netherlands ..... 8503149

[51] Int. Cl.[4] ..... B04B 9/12

[52] U.S. Cl. ..... 494/20

[58] Field of Search ..... 494/16, 17, 18, 20

[56] References Cited

U.S. PATENT DOCUMENTS

| | | | |
|---|---|---|---|
| 3,347,453 | 10/1967 | Goergen . | |
| 3,393,864 | 7/1968 | Galasso et al. | 494/20 |
| 3,487,994 | 1/1970 | Moore . | |
| 3,752,390 | 8/1973 | Chulay . | |
| 3,935,995 | 2/1976 | Williams et al. | 494/20 |
| 3,997,105 | 12/1976 | Hayden et al. | 494/20 |
| 4,190,195 | 2/1980 | Chulay | 494/20 |
| 4,254,905 | 3/1981 | Baumler et al. | 494/20 |
| 4,435,167 | 3/1984 | Stower | 494/16 |
| 4,484,906 | 11/1984 | Strain | 494/16 |

FOREIGN PATENT DOCUMENTS 1782602 3/1972 Fed. Rep. of Germany .

3141261 5/1983 Fed. Rep. of Germany .

*Primary Examiner*—David Werner

*Attorney, Agent, or Firm*—Cushman, Darby & Cushman

[57] ABSTRACT

A centrifuge in particular for medical use, comprising a vacuum chamber housing a centrifuge rotor, means for driving said rotor, at least one elongate vessel for substances to be separated, which vessel is pivotally suspended from the rotor in a pivot in such a manner that the central longitudinal axis of the vessel is directed substantially vertically when the rotor is at rest, but occupies a radial position at least at the operating speed of the rotor, in which latter position the vessel extends through an opening in an element formed integrally with, or attached to the rotor, in which position the vessel is retained in the radial outward direction by retaining means. According to the invention, the pivot is constructed and mounted on the rotor in such a manner that, in operation, at a low increasing speed of the rotor, the central longitudinal axis of the vessel pivots from the substantially vertical position to the radial position and upon a further increasing speed of the rotor the pivot moves in the radial direction towards said opening so that the vessel slides into said opening in a position in which longitudinal axis extends in a radial direction, the opening being designed so that it fully surrounds the outer circumference of the vessel.

6 Claims, 3 Drawing Sheets

CENTRIFUGE, IN PARTICULAR FOR BIOMEDICAL USE

This invention relates to a centrifuge, in particular for biomedical use.

Centrifuges of this type are used for separating heat-sensitive particles, such as live cells, from a liquid in which they are contained by means of centrifugal forces.

Specifically, the invention relates to a centrifuge comprising a vacuum chamber housing a centrifuge rotor, means for driving said rotor, at least one elongate vessel for substances to be separated, said vessel being pivotally suspended from the rotor by means of a pivot construction in such a manner that the central longitudinal axis of the vessel is directed substantially vertically when the rotor is at rest, but occupies a radial position at least at the operating speed of the rotor, in which latter position the vessel extends through an opening in an element formed integrally with, or attached to the rotor, in which position the vessel is retained in the radial outward direction by retaining means.

A similar centrifuge of this type is known, for example, from U.S. Pat. No. 3,347,453.

In this prior apparatus, the pivot is not movable relatively to the rotor, and the opening has the shape of an inverted capital U. When the rotor of the prior centrifuge is started to rotate, the elongate vessel, which is of cylindrical configuration, will pivot from the position in which the longitudinal axis of the vessel is substantial vertical to a position in which the longitudinal axis is directed radially. The location of the U-shaped opening is such that, after completion of the pivotal movement, the vessel is within the U-shaped opening and its cylindrical outer wall abuts the semi-cylindrical portion of the U-shaped opening. In this prior centrifuge, the retaining means between the vessel and the U-shaped opening for retaining the vessel in the radially outward direction are constituted by a projection or collar extending through an angle of 180° or less, and which is arranged to co-operate with the rim of the semi-cylindrical portion of the U-shaped opening. As a consequence, in the radially outward direction, the vessel is only moderately retained, so that the retaining means are not resistant to the centrifugal forces associated with very high rotor speeds.

It is an object of the present invention to provide an improvement of the prior centrifuge in such a manner that retaining means can be used which are resistant to the centrifugal forces associated with very high rotor speeds, in particular speeds of 75,000 rpm or higher. To this effect, according to the present invention, the above centrifuge is characterized in that the pivot is constructed and mounted on the rotor in such a manner that at a low increasing speed of the rotor the central longitudinal axis of the vessel pivots from the substantially vertical position to the radial position and upon a further increasing speed of the rotor the pivot moves in the radial direction towards said opening so that the vessel slides into said opening in a position in which its longitudinal axis extends in a radial direction, the opening being designed so that it fully surrounds the outer circumference of the vessel and that the locking means extend around the entire outer circumference of the vessel.

In an attractive embodiment of the centrifuge according to the present invention, a spring system is provided, which opposes the radial displacement of the pivot towards the opening.

The spring system may be of the mechanical, pneumatic, or pneumatic-hydraulic type.

A number of possible embodiments of the invention will now be described, by way of example, with reference to the accompanying, highly diagrammatic drawings, showing such embodiments in longitudinal sectional view. In said drawings, FIG. 1 shows a first embodiment with a spring system of the mechanical type;

Figure 1:
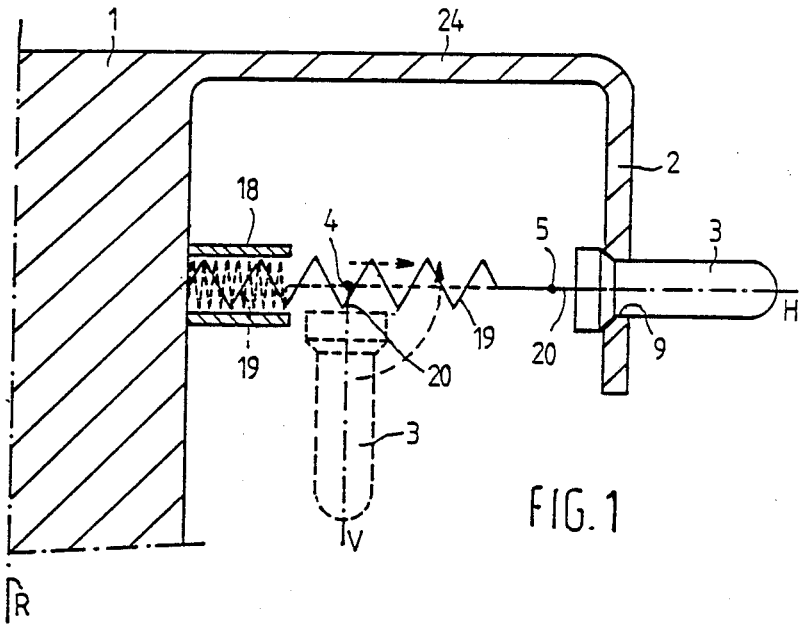

The elongated vessel will now be described in more detail, with reference to the embodiment thereof as designated by reference numeral 3 in FIGS. 1, 2, 3, 4 and 5, and as designated by reference numeral 13 in FIG. 6.

As shown, the vessel (see in particular FIG. 5) comprises a cylindrical portion 6 which merges into a portion 7 consisting of a part of a cone. The conical portion 7 again merges into a cylindrical portion 8. In the position of vessel 3 illustrated in FIG. 5, in which the central longitudinal axis of vessel 3 is in the radial position H, vessel 3 extends through an opening 9 in an annular element 2 positioned coaxially relatively to centrifuge rotor 1 and attached thereto or formed integrally with it. The wall of opening 9 is formed by a cylindrical portion 10 merging into a portion 11 formed by a part of a cone.

In the position shown, in which the central longitudinal axis of vessel 3 is in the radial position H, the cylindrical portion 10 of opening 9 fully surrounds the cylindrical portion 6 of vessel 3, while the conical portion 11 of opening 9 fully surrounds the conical portion 7 of vessel 3. In that position part 7 abuts part 11 of the opening. Parts 7 and 11 form effective retaining means for retaining vessel 3 in the radial direction and resistant to excessive centrifugal forces associated with high rotor speeds of, for example, 75,000 rpm or higher. As opening 9 in element 2 fully and closely surrounds vessel 3, a very effective support of vessel 3 is obtained, and, if necessary, element 2 can be reinforced around opening 9 in a relatively simple manner.

Figure 6:
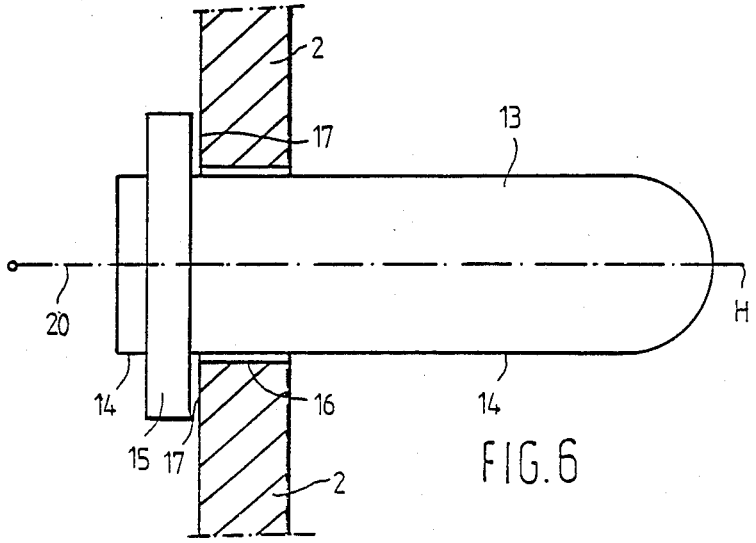
FIG. 6 shows a second embodiment of the vessel with retaining means while the vessel is located within the opening.

The embodiment of elongate vessel 13 as illustrated in FIG. 6 differs from vessel 3 described above in that vessel 13 has a continuous cylindrical portion 14 to which a collar 15, fully surrounding vessel 13, is fixedly secured adjacent one end of vessel 13. In the position shown in FIG. 6, in which the central longitudinal axis of vessel 13 is in the radial position H, vessel 13 extends through an opening 16 which is of fully cylindrical construction, in element 2 referred to above. The wall of opening 16 is cylindrical and surrounds cylindrical vessel 13. In the state shown, in which vessel 13 is in the radial position H, collar 15 abuts a rim 17 around opening 16. Collar 15 and rim 17 form effective retaining means for retaining vessel 13 in the radial direction, and resistant to excessive centrifugal forces associated with high rotor speeds of, for example, 75,000 rpm or higher. As opening 16 in element 2 fully and closely surrounds vessel 13, a very effective support of vessel 13 is obtained, and, if necessary, element 2 around opening 16 can be reinforced in a relatively simple manner.

Figure 3:
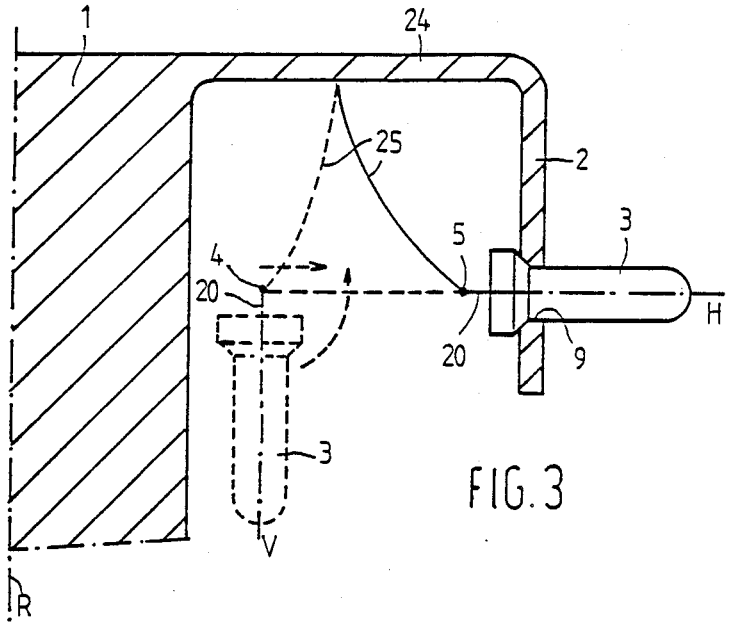
FIG. 3 shows a third embodiment with a spring system of the mechanical type.
Figure 4:
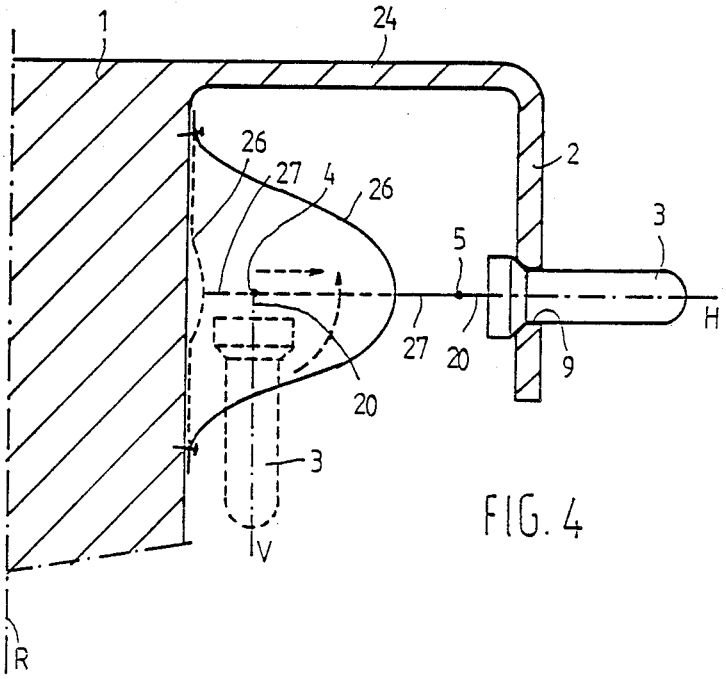
FIG. 4 shows a fourth embodiment with a spring system of the mechanical type.
Figure 5:
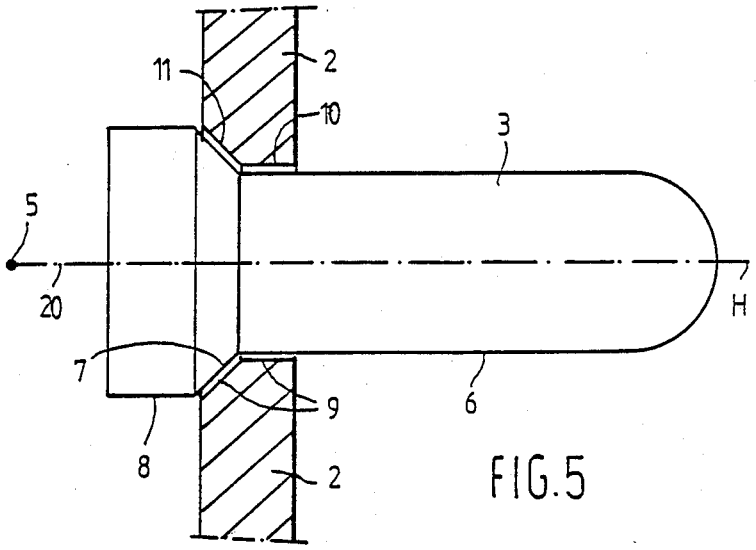
FIG. 5 shows a first embodiment of the vessel with retaining means while the vessel is located within the opening.

In FIGS. 1, 2, 3 and 4, the pivot is designated by reference numeral 4 in the position in which the rotor is at rest or rotates at a low speed (referred to herein as the initial position) and in the same Figures and in FIGS. 5 and 6, the pivot is designated by reference numeral 5 in the position it occupies when the rotor rotates at a high speed (referred to herein as the end position).

In all Figures, a connecting element between vessel 3 or 13 and the pivot is designated by reference numeral 20.

In FIGS. 1, 2, 3 and 4, the position of vessel 3 when the rotor is at rest, and in which the central longitudinal axis of vessel 3 is directed substantially vertically (position of longitudinal axis V) is shown dotted. In FIGS. 1 to 4, inclusive, the connection between element 2 and rotor 1 is designated by reference numeral 24. In the embodiment of FIG. 1, a sleeve 18 is fixedly secured to centrifuge rotor 1. Placed within sleeve 18 is a spring 19, one end of which is fixed to rotor 1, and the other end of which is fixed to the pivot. Spring 19 is shown dotted in the initial position of the pivot in point 4, and the spring 19 is shown in solid lines in the final position of the pivot in point 5.

Figure 2:
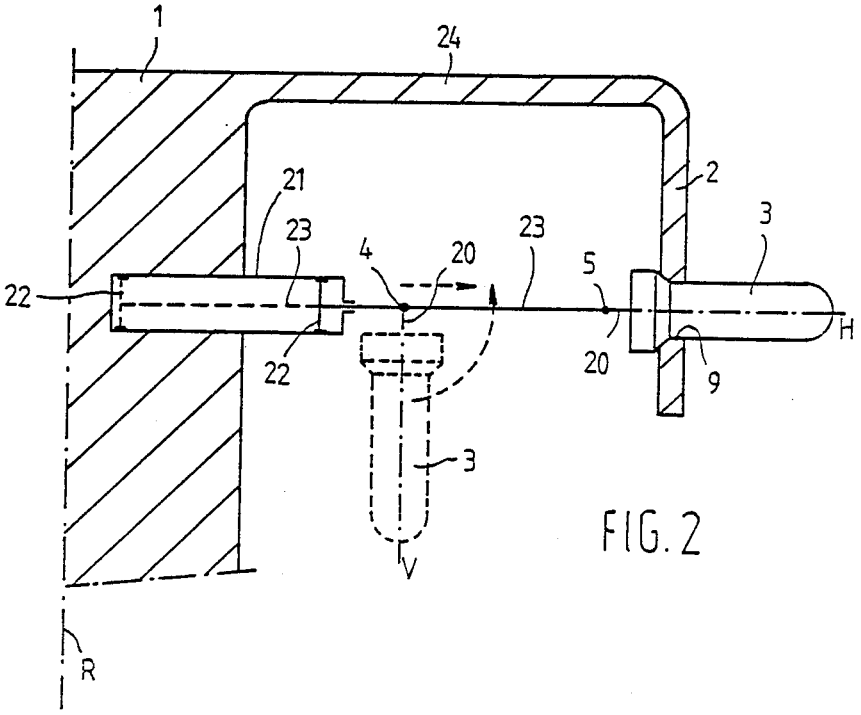
FIG. 2 shows a second embodiment with a spring system of the pneumatic type.

In the embodiment shown in FIG. 2, a pneumatic spring is provided. This spring is comprised by a cylinder 21 in rotor 1, housing a piston 22 provided with a piston rod 23. One end of piston rod 23 is fixed to piston 22 and the other end of piston rod 23 is secured to the pivot. Piston 22 and piston rod 23 are shown in ghost outline in the initial position of the pivot in point 4 and the same parts are shown in solid lines in the final position of the pivot in point 5.

In the embodiment illustrated in FIG. 3, a spring rod or leaf spring 25 has one end fixedly secured to connection 24 and the other end to the pivot. Spring rod 25 is shown dotted in the initial position of the pivot in point 4 and in solid lines in the end position of the pivot in point 5.

In the embodiment shown in FIG. 4, a spring 26 has both ends fixedly secured to rotor 1. Secured transversely to the spring is a rod 27 which carries the pivot at its free end. Spring 26 and rod 27 are shown dotted in the initial position of the pivot in point 4 and spring 26 and rod 27 are shown in solid lines in the end position of the pivot in point 5.

The operation of the embodiment illustrated in FIGS. 1 to 4, inclusive, which in principle is the same in all cases, will now be described.

In the initial position, that is to say, when rotor 1 is at rest, vessel 3 occupies the position as shown by the dotted lines. The central longitudinal axis of vessel 3 is then in the vertical position V. When rotor 1 is now started (after vessel 3 has been filled with materials to be separated) and starts to rotate around rotor axis R with a gradually increasing speed, owing to the action of the centrifugal forces vessel 3 will be pivoted about the pivot, which initially is in point 4, until vessel 3 and the central longitudinal axis of vessel 3 have reached the radial position H. When the speed of rotor 1 is further increased, the increasing centrifugal force will move vessel 3 in the radial direction, against the spring forces, towards opening 9 in clement 2. Ultimately, owing to the action of the centrifugal force, vessel 3 will radially slide into opening 9 until retaining means 7 and 11 contact each other and vessel 3 has reached the position as shown in solid lines in FIGS. 1, 2, 3, 4 and 5. Once vessel 3 has reached that position, the speed of rotor 1 can be increased to the desired operating speed.

In principle, the operation of the apparatus described is the same if, instead of vessel 3, vessel 13 is used.

In the accompanying drawings and in the above description, only one elongate vessel is shown and described to be secured to the rotor. In practice, a relatively large number, for example, 8 or 12, of such elongate vessels will be uniformly spaced about rotor 1 and mounted thereon in the manner described.

It is noted that, in the initial position of the elongate vessel, the central longitudinal axis of the vessel need not be directed truly vertically. For example, rotor 1 may include a sloping surface against which the elongate vessel rests in its initial position so that its central longitudinal axis occupies a sloping position rather than a truly vertical one.

We claim:

1. A centrifuge, in particular for biomedical use, comprising:

a vacuum chamber housing a centrifuge rotor;

means for driving said rotor about a rotation axis;

at least one elongate vessel for holding substances to be separated;

an element formed integrally with, or attached to, the rotor and having an opening therein which extends radially with respect to said rotation axis;

a pivot system mounting said vessel to said rotor, said pivot system including means forming a horizontal swing axis located radially inwardly of said opening at a distance therefrom such that said vessel is swingable about said swing axis between a first position in which the longitudinal axis of said vessel is vertical and a second position in which the longitudinal axis of said vessel is radial with respect to said rotation axis of said rotor in which the end of said vessel remote from said swing axis lies radially inwardly of said opening with respect to said rotation axis, said pivot system further including; means mounting said swing-axis means for radial movement toward and away from the rotation axis of said rotor, said mounting means being constructed and arranged in such a manner that at a low increasing speed of the rotor said vessel swings from said first position to said second position and upon a further increasing speed of said rotor said swing-axis means moves radially outward with respect to the rotation axis of said rotor so that said vessel slides into said opening, said opening having a shape and size such that it entirely surrounds and engages the outer circumference of said vessel and thereby supports said vessel in said second position.

2. A centrifuge as in claim 1 wherein said mounting means for said swing axis means includes a spring system which opposes the radially outward movement of said swing axis means.

3. A centrifuge as in claim 2 wherein said spring system is mechanical.

4. A centrifuge as in claim 2 wherein said spring system is pneumatic.

5. A centrifuge as in claim 1 wherein the outside of said vessel and the inside of the opening are cylindrical and wherein said vessel is provided adjacent one end with a collor which, at least at high operating speed of said rotor, abuts against an edge of the opening.

6. A centrifuge as in claim 1 wherein the outside of said vessel and the inside of said opening are formed as parts of cylinders and of cones.

* * * * *